United States Patent [19]

Belokin, Jr.

[11] Patent Number: 4,511,200

[45] Date of Patent: Apr. 16, 1985

[54] ELECTRICAL CONNECTOR HAVING HANDLE-MOUNTED BIFURCATED RESILIENT PIN-ENGAGING ELECTRICAL PLATE

[76] Inventor: Paul Belokin, Jr., Rte. 4, Box D, Hayward, Wis. 54843

[21] Appl. No.: 446,241

[22] Filed: Dec. 2, 1982

[51] Int. Cl.[3] ..... H01R 33/08; H01R 4/24

[52] U.S. Cl. ..... 339/50 R; 339/53; 339/220 R; 339/258 R; 339/277 R

[58] Field of Search ..... 339/50, 52, 53, 56, 339/220 R, 220 L, 220 T, 221 R, 221 L, 221 M, 217 R, 276 T, 276 F, 277 R, 257, 258 R, 258 P

[56] References Cited

U.S. PATENT DOCUMENTS

| | | | |
|---|---|---|---|
| 2,601,276 | 6/1952 | Gordon | 339/277 R |
| 2,973,500 | 2/1961 | Pistey | 339/53 |
| 3,052,864 | 9/1962 | Gaynor | 339/53 |
| 3,381,263 | 4/1968 | Gehrt et al. | 339/277 |
| 3,989,335 | 11/1976 | Belokin, Jr. | 339/50 R |
| 4,218,106 | 8/1980 | Belokin, Jr. | 339/277 R |
| 4,230,383 | 10/1980 | Burnstein et al. | 339/220 R |
| 4,416,503 | 11/1983 | Hayes | 339/220 R |

*Primary Examiner*—Joseph H. McGlynn
*Assistant Examiner*—Paula Austin
*Attorney, Agent, or Firm*—James E. Nilles

[57] ABSTRACT

An electrical connector attached to the end of a wire and for releasable engagement with an electrically conductive cylindrical pin at the end of a fixture-mounted fluorescent tube comprises an insulating handle on which is mounted a resilient metal electrically conductive plate. The plate includes a barbed portion which fits into a slot in the handle thereby securing the plate to the handle. The wire is frictionally secured to the barbed portion of the plate within the slot. The plate also includes an outer portion having coplanar prongs on opposite sides of a narrow-throated pin-receiving and engaging aperture which extends inwardly from an outer edge of the plate. The prong edges bordering the aperture make electrical contact with the pin. A slit extending from the aperture and between the prongs facilitates temporary displacement of the resilient prongs from their common plane in opposite directions to enable widening of the aperture throat sufficiently to accommodate pin passage.

7 Claims, 8 Drawing Figures

ELECTRICAL CONNECTOR HAVING HANDLE-MOUNTED BIFURCATED RESILIENT PIN-ENGAGING ELECTRICAL PLATE

BACKGROUND OF THE INVENTION

1. Field of Use

This invention relates generally to electrical connectors and, in particular, to plate-like connectors for use with electrically conductive pins at the ends of fixture-mounted fluorescent tubes.

2. Description of the Prior Art

U.S. Pat. No. 4,218,106, owned by the assignee of the present application, discloses an electrical connector of the aforesaid character. Particularly, an electrical connector attached to the end of a wire and for releasable engagement with an electrically conductive cylindrical pin at the end of a fixture-mounted fluorescent tube comprises a resilient electrically conductive metal plate having coplanar prongs on opposite sides of a narrow-throated pin-receiving and engaging aperture which extends inwardly from an outer edge of the plate. The prong edges bordering the aperture make electrical contact with the pin. A slit extending from the aperture and between the prongs facilitates temporary displacement of the resilient prongs from their common plane in opposite directions to enable widening of the aperture throat sufficiently to accommodate pin passage. Insulating material covers the metal plate except for the prong edges bordering the aperture.

SUMMARY OF THE PRESENT INVENTION

An electrical connector attached to the end of a wire and for releasable engagement with an electrically conductive cylindrical pin at the end of a fixture-mounted fluorescent tube comprises an insulating handle on which is mounted a resilient metal electrically conductive plate. The plate includes a barbed portion which fits into a slot in the handle thereby securing the plate to the handle. The wire is frictionally secured to the barbed portion of the plate within the slot. The plate also includes an outer portion having coplanar prongs on opposite sides of a narrow-throated pin-receiving and engaging aperture which extends inwardly from an outer edge of the plate. The prong edges bordering the aperture make electrical contact with the pin. A slit extending from the aperture and between the prongs facilitates temporary displacement of the resilient prongs from their common plane in opposite directions to enable widening of the aperture throat sufficiently to accommodate pin passage.

A connector in accordance with the present invention is so constructed that insertion of the barbed portion of the plate into the handle slot simultaneously results in permanent connection of the plate and the handle and permanent electrical and mechanical connection of the wire to the plate, without the need for additional attachment means such as adhesives or soldering materials.

A connector in accordance with the invention has several advantages over the prior art. For example, a connector in accordance with the invention can be easily attached or detached from the fluorescent tube pin without removal of the tube pin from its associated fixture receptacle. Furthermore, provision of the handle provides a better grip and facilitates manual attachment and detachment of the connector to the tube pin. The handle also provides for an added degree of electrical insulation. A connector in accordance with the invention is relatively simple in construction, economical to fabricate, easy to use, and well insulated against short-circuiting on the fixture and against shock hazard by the user. Other objects and advantages of the invention will hereinafter appear.

DESCRIPTION OF A PREFERRED EMBODIMENT

Figure 1:
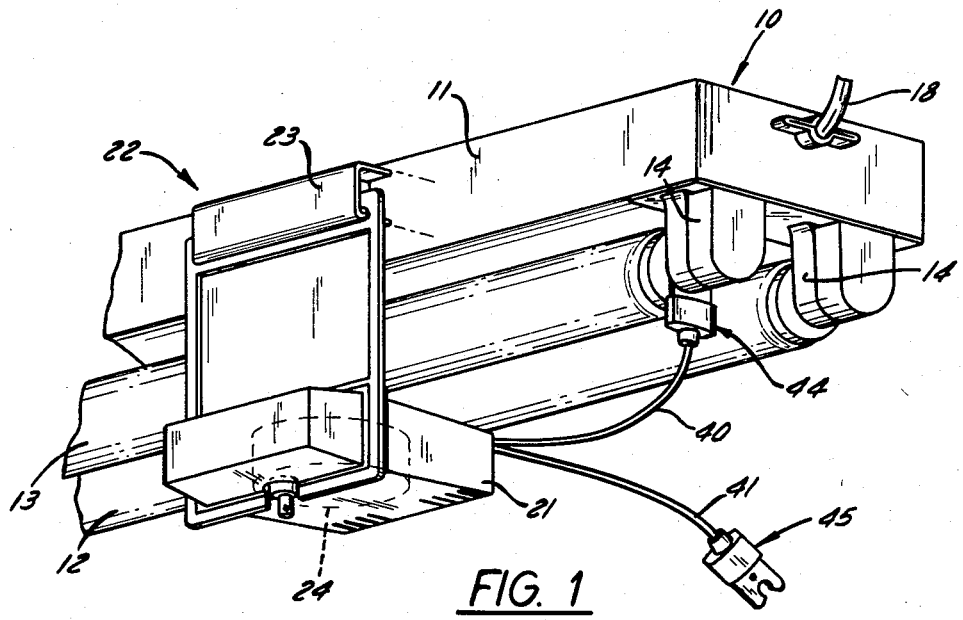
FIG. 1 is a perspective view of one end of a fluorescent light ceiling fixture on which a pair of fluorescent tubes are mounted and shows a power take-off unit having connectors in accordance with the present invention associated therewith.
Figure 2:
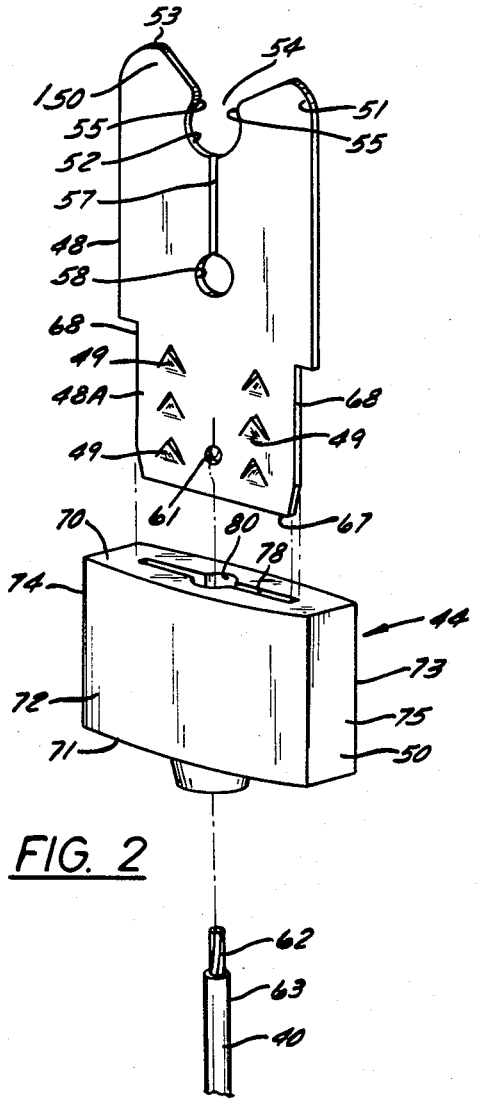
FIG. 2 is an enlarged, exploded perspective view of one of the connectors of FIG. 1 showing the component parts thereof prior to final assembly.
Figure 3:
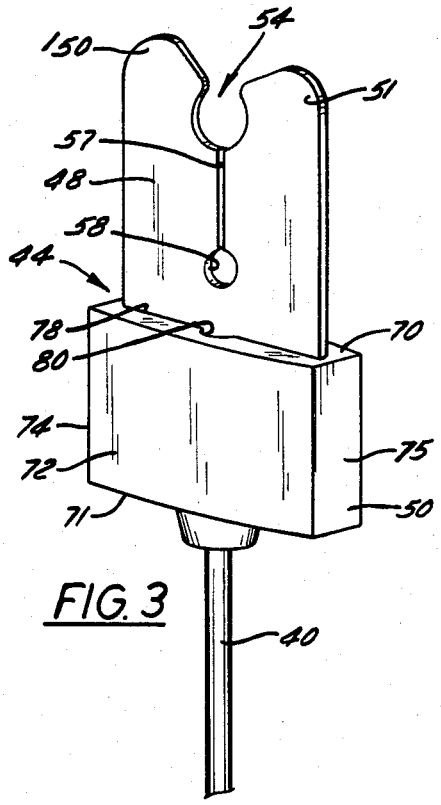
FIG. 3 is a perspective view of the fully assembled connector of FIG. 2.
Figure 4:
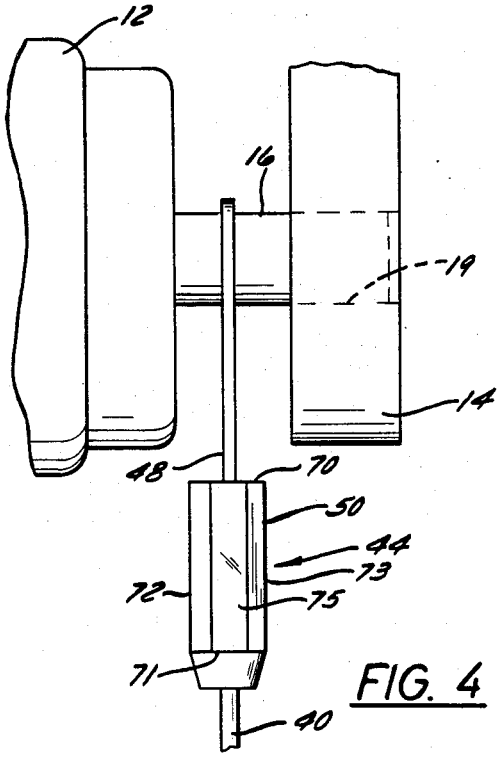
FIG. 4 is a side elevational view of one of the connectors of FIG. 1 and showing it connected to an associated fluorescent tube pin.

Referring to FIG. 1, there is shown a ceiling-mounted fluorescent light fixture 10 which comprises a sheet metal housing 11 which is attached to the ceiling of a room, for example, and on which a pair of fluorescent lights or tubes 12 and 13 are mounted. Fixture 10 comprises a pair of adjacent fixture terminals 14 for one end thereof and, as FIG. 4 shows, each fixture terminal 14 has at least one electrically conductive pin receptacle 19 thereon. Each fluorescent tube 12, 13 has at least one electrically conductive pin 16 engaged with the pin receptacle 19 of its associated fixture terminal 14. Fixture 10 includes a cord 18 connecting it to an electrical power source.

Figure 5:
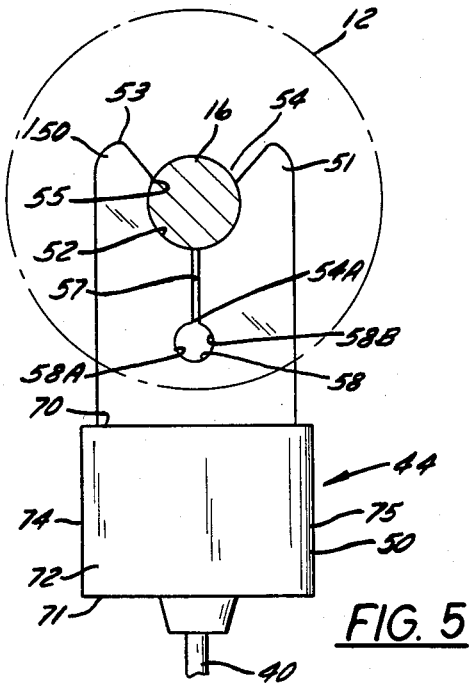
FIG. 5 is an end elevational view taken on line 5—5 of FIG. 4.

FIG. 1 also shows a power take-off unit 22 for use with fixture 10 and the tubes 12, 13 thereon. Power take-off unit 22 generally comprises a frame or housing 21 and means, such as a permanent magnet, 23 for supporting the power take-off unit near one end of the fixture 10 and a foreign electrical load, such as a small electric motor 24, which is supported in the housing 21. Means are provided in unit 22 for supplying electric power from the pin receptacles 19 of the pair of adjacent fixture terminals 14, through the pins 16 associated therewith, to the foreign load 24. Such means comprise a pair of electrical conductors 40 and 41, and a pair of connectors 44 and 45, respectively, connected to the conductors. As hereinafter explained in detail, the connectors 44 and 45 are identical to each other, and each comprises an electrically conductive plate 48 which is mounted on a handle 50. Each electrical conductor 40, 41 has one end electrically connected or connectable to the load 24 and another end connected to the electrically conductive plate 48 of its associated connector 44, 45. FIGS. 1, 4 and 5 show connector 44 attached to pin 16 of tube 12. FIG. 1 also shows connector 45 detached from pin 16 of tube 13 with which it would normally be associated.

FIGS. 1, 4 and 5 show a fluorescent tube 12 having a single relatively large diameter pin 16 at one end thereof and such construction is typical of commercially available 8-foot long tubes. However, some 4-foot long commercially available tubes may employ two relatively small diameter pins (not shown) at one end thereof and a connector such as 44 is usable therewith if suitably modified.

Since connectors 44 and 45 are identical to each other, only connector 44 is hereinafter described in detail. As FIGS. 2–8 show, connector 44 generally comprises a handle, body or base member 50 to which is attached a plate 48.

The handle 50, which is fabricated by molding in one piece from plastic electrical insulating material, comprises an upper side 70, a lower side 71, a front side 72, a rear side 73 and flat edges designated 74 and 75. A slot 78 extends inwardly into handle 50 from upper side 70 and communicates with a wire-receiving bore, hole or aperture 80 which extends inwardly into handle 50 from lower side 71. Slot 78 comprises generally flat spaced apart but confronting inside surfaces 81 and 82, and each surface 81, 82 includes a semi-cylindrical depression 81A and 82A which is an extension of bore 80.

Figure 8:
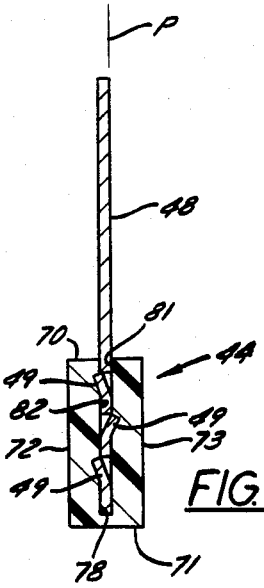
FIG. 8 is a cross-section view taken on line 8—8 of FIG. 6

The connector plate 48 comprises an outwardly extending portion and an inner end portion or tang 48A which is provided with a plurality (six shown) of integrally formed punched barbs 49 and with a wire-receiving opening or aperture 61. The barbs 49 are arranged in two columns and three rows and adjacent barbs in each column are bent and protrude from tang 48A in opposite directions from plane P (FIG. 8). The connector plate 48 becomes permanently attached to handle 50 when tang 48A is forcefully inserted into slot 78 in handle 50 and the barbs 49 frictionally engage the inside walls or surfaces 81 or 82 of slot 78, as FIG. 8 shows, to obviate the need for adhesives or other means of securement. Flat thin bifurcated resilient insulated electrical connector plate 48 is attached to one end of electrical conductor 40 and is adapted for releasable edgewise engagement with the electrically conductive cylindrical pin 16 at one end of fixture-mounted fluorescent tube 12. The electrically conductive flat thin bifurcated resilient metal plate 48 to which conductor wire 40 is attached has coplanar flat prongs 150 and 51 disposed on opposite sides of a narrow-throated pin-receiving and pin-engaging aperture 52 which extends inwardly from an outer edge 53 of the plate. The prong edges 55 bordering the pin-receiving aperture 52 make electrical contact with the outside of the pin 16. A slit or slot 57 extending from the aperture 52 and between the prongs 150 and 51 in a direction away from and transverse to the outer edge 53 of the plate 48 facilitates temporary displacement of the resilient prongs 150 and 51 in opposite directions from their common plane P (See FIG. 8) to enable widening of the aperture throat 54 for accommodating pin passage (See FIGS. 4 and 5).

Figure 6:
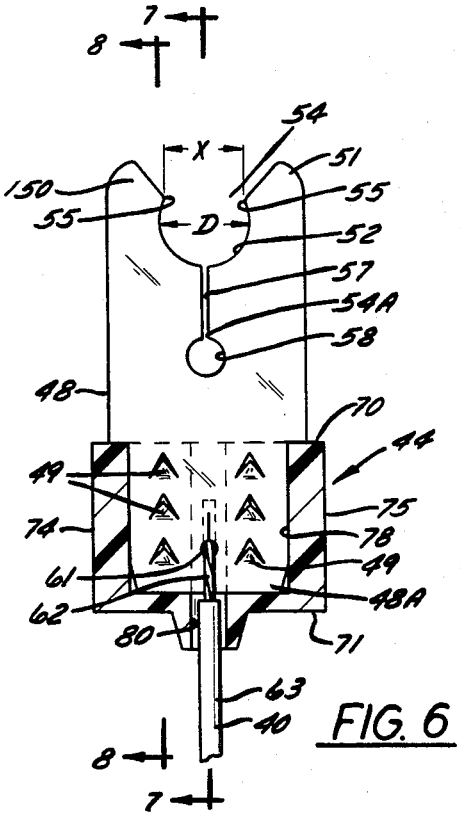
FIG. 6 is a view of the connector shown in FIGS. 1-5 but with the insulating material removed so as to illustrate structural details of the metal plate therewithin.
Figure 7:
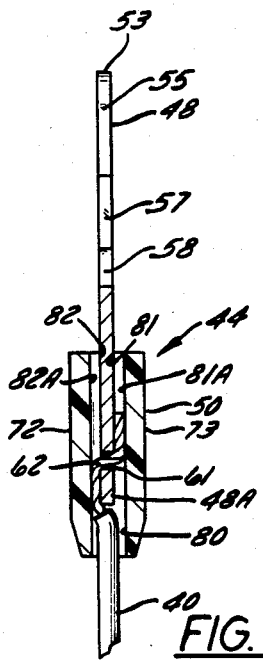
FIG. 7 is a cross-section view taken on line 7—7 of FIG. 6.

As FIGS. 6 and 7 best show, electrical conductor 40 takes the form of a flexible wire comprising an electrically conductive twisted wire 62 and a covering of insulation 63. Wire 62 of conductor 40 has one end electrically and mechanically connected to an end of metal plate 48 of connector 44. Conductor 40 extends through bore 80 in handle 50 and the bare wire 62 thereof extends through wire-receiving opening 61 in tang 48A of plate 48, being finally arranged and entrapped as shown in FIG. 7, and no solder, screw, crimping or adhesive is needed to secure wire 62 to plate 48.

Connector 44 is assembled in the following manner. First, as FIG. 2 makes clear, stripped electrical conductor 40 is inserted through bore 80 and through slot 78 outwardly beyond upper side 70 of handle 50. Then, bare wire 62 is inserted through opening 61 in tang 48A of plate 48 as FIGS. 6 and 7 indicate. Then, tang 48A of plate 48 (with conductor 40 associated therewith) is pushed into slot 78 (see FIGS. 3 and 6) from the position shown in FIG. 2, and assembly is thus completed.

Metal plate 48, which is preferably fabricated of resilient copper or bronze, for example, has the forward edge 53, hereinbefore referred to, a rear edge 67 and spaced apart side edges 68. Metal plate 48 is provided with the pin-receiving aperture or hole 52 which extends inwardly from forward edge 53 and the slit or slot 57 extending from aperture 52 in a direction away from forward edge 53 toward rear edge 67. Aperture 52 and slot 57 cooperate to cause plate 48 to take the form of a bifurcated plate having the two branches, forks, blades, or legs 150 and 51 which are temporarily displaceable relative to each other from the common plane P (see FIG. 8) in which they normally lie. The slot 57 enables substantially greater relative displacement of the blades 150 and 51 without permanent deformation of plate 48 than would be possible if only aperture 52 were provided.

As FIGS. 5 and 6 best show, aperture 52 has a shape generally similar to that of the cross-sectional configuration of tube pin 16 but is slightly larger. In the embodiment disclosed, pin 16 is of circular cross section and aperture 52 is also generally circular and has a slightly larger diameter than pin 16. However, other pin and aperture shapes are possible. As FIG. 6 shows, aperture 52 has a diameter designated D which is greater than the dimension X of the throat 54. As a result, pin 16 cannot be directly inserted through throat 54 into aperture 52 unless the connector 44 is manipulated as shown in FIGS. 4 and 5 to cause the distance across the throat 54 to be increased to a dimension greater than diameter D of pin 16. However, when the pin 16 is inserted in aperture 52, the pin is mechanically secured therewithin and cannot be removed therefrom unless the prongs 150 and 51 are displaced. As FIG. 5 makes clear, the edges 55 of the prongs 150 and 51 of metal plate 48 make electrical contact with points on the circumference of pin 16.

Connector 44 and plate 48 thereof are further provided with a relatively small pin-receiving aperture 58 which is defined by semi-circular indentations 58A and 58B extending inwardly from slot 57 into the blades or prongs 150 and 51. Aperture 58, which is located inwardly of the larger aperture 52 and is adapted to accommodate a small-diameter pin (not shown) of a fluorescent tube (not shown) when connector 44 is used with such a tube, instead of the type of tube shown in FIGS. 1, 4 and 5. Slot 57 facilitates planar displacement of the prongs 150 and 51 when the throat 54A of aperture 58 needs to be widened to accommodate a pin during connection or disconnection of the connector 44.

In an actual embodiment of the invention, plate 48 was on the order of 1.245 inches long, 0.650 inches wide at its widest portion, and 0.010 inches thick. Each barb 49 was on the order of 0.088 inches long, 0.100 inches wide at its base end, and extended at an angle of between about 15° to 25° from plane P. The distance between the surfaces 81 and 82 defining slot 78 in handle 43 was about 0.040 inches.

Centerline spacing between the two columns of barbs 49 was 0.288 inches and between each adjacent row of barbs was 0.180 inches.

I claim:

1. An electrical connector for releasable connection to an electrically conductive pin and adapted to be attached to an uninsulated end of an electrical conductor wire, said connector comprising:

a base member fabricated of electrical insulating material and having a slot extending thereinto from a surface thereof, and having a wire-receiving aperture communicating with said slot; and an electrically conductive member comprising an inner portion received within said slot in said base member and an outer portion extending from said slot and engageable with said pin, said inner portion of said electrically conductive member comprising at least one barb frictionally engaged with said base member within said slot and further comprising a wire-engaging aperture engageable with said uninsulated end of an electrical conductor wire extending into said wire-receiving aperture in said base member whereby said uninsulated end of said electrical conductor wire is mechanically trapped between said inner portion of said electrically conductive member and a wall of said slot and is in electrical contact with said electrically conductive member.

2. An electrical connector according to claim 1 wherein said wire-receiving aperture in said base member extends inwardly from a surface other than said surface from which said slot extends.

3. An electrical connector according to claim 1 or 2 wherein said inner portion of said electrically conductive member comprises a plurality of barbs which project from opposite sides of said conductive member.

4. An electrical connector according to claim 1 or 2 wherein said outer portion of said electrically conductive member includes a recess for accommodating said pin.

5. In combination:

an electrical conductor wire having a bare end portion; and and electrical connector attached to said wire for releasable connection to an electrically conductive pin, said connector comprising:

a base member fabricated of electrical insulating material and having a slot extending thereinto from one surface thereof, and having a wire-receiving aperture extending thereinto from another surface opposite said one surface and communicating with said slot; and an electrically conductive member comprising an inner portion received within said slot in said base and an outer portion extending from said slot and engageable with said pin, said inner portion of said electrically conductive member comprising at least one barb frictionally engaged with said base member within said slot and further comprising a wire-engaging aperture;

said conductor wire extending through said wire-receiving aperture in said base member and said bare end portion of said wire extending through said wire-engaging aperture in said inner portion of said electrically conductive member and mechanically entrapped between said electrically conductive member and said base member within said slot in electrical contact with said inner portion of said electrically conductive member.

6. A combination according to claim 5 wherein said inner portion of said electrically conductive member comprises a plurality of barbs which project from opposite sides of said conductive member.

7. A combination according to claim 5 or 6 wherein said outer portion of said electrically conductive member includes a recess for accommodating said pin.

* * * * *